US009950887B2

(12) United States Patent
Koyama et al.

(10) Patent No.: US 9,950,887 B2
(45) Date of Patent: Apr. 24, 2018

(54) SHEET DETECTING DEVICE AND IMAGE FORMING APPARATUS

(71) Applicant: CANON KABUSHIKI KAISHA, Tokyo (JP)

(72) Inventors: Tomooku Koyama, Suntou-gun (JP); Naoyuki Maeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/069,780

(22) Filed: Mar. 14, 2016

(65) Prior Publication Data

US 2016/0272447 A1 Sep. 22, 2016

(30) Foreign Application Priority Data

Mar. 17, 2015 (JP) ..... 2015-053016

(51) Int. Cl.
*B65H 7/14* (2006.01)
*B65H 5/06* (2006.01)

(52) U.S. Cl.
CPC ..... *B65H 7/14* (2013.01); *B65H 5/062* (2013.01); *B65H 2402/542* (2013.01); *B65H 2404/611* (2013.01); *B65H 2553/412* (2013.01); *B65H 2553/612* (2013.01); *B65H 2801/06* (2013.01)

(58) Field of Classification Search
CPC B65H 7/14; B65H 2553/61; B65H 2553/612; B65H 2553/60; B65H 2553/412
See application file for complete search history.

(56) References Cited

U.S. PATENT DOCUMENTS 5,882,130 A * 3/1999 Kumazaki ..... B65H 7/02 271/265.01
7,182,336 B2 * 2/2007 Fukushima ..... B65H 1/022 271/264
8,328,191 B2 * 12/2012 Tamura ..... B65H 9/00 271/258.01
9,254,976 B2 * 2/2016 Koga ..... B65H 7/06
9,302,878 B2 * 4/2016 Ono ..... B65H 31/02
2012/0181741 A1 7/2012 Suzuki
2013/0264768 A1 * 10/2013 Araishi ..... B65H 7/02 271/264
2014/0361482 A1 * 12/2014 Iizuka ..... B65H 7/08 271/111

FOREIGN PATENT DOCUMENTS

JP 2003-252483 A 9/2003
JP 2012-144350 A 8/2012

* cited by examiner

*Primary Examiner* — Jeremy R Severson
(74) *Attorney, Agent, or Firm* — Canon U.S.A., Inc. IP Division

(57) ABSTRACT

After a detection flag and a detection member are integrally rotated as a result of the detection flag being pushed by a sheet, the detection flag is rotated relative to the detection member, with the detection member being in contact with an abutting portion.

8 Claims, 9 Drawing Sheets

SHEET DETECTING DEVICE AND IMAGE FORMING APPARATUS

BACKGROUND

Field of the Disclosure

The present disclosure generally relates to a sheet detecting device and an image forming apparatus.

Description of the Related Art

Typically, copiers, printers, facsimiles, image reading devices, various finishers, etc. are provided with a sheet detecting device for detecting the passage of a sheet when a sheet, serving as a recording medium, is conveyed.

Examples of a typically used sheet detecting device include a detecting unit that uses a flag which is moved by being pressed by a sheet and a sensor for detecting the flag.

The sheet detecting device that uses the flag is formed of a detection flag, an urging spring, a sensor, a holder for holding these parts, etc. The detection flag is urged in a predetermined direction by the urging spring and is stationed at a standby position so as to cross a sheet conveyance path. When the leading end of a sheet reaches the detection flag, the sheet starts to tilt the detection flag, and, when the detection flag has tilted by a predetermined amount, the sensor detects the tilting of the detection flag. Thereafter, when the trailing end of the sheet has passed through the detection flag, the detection flag returns to the standby position by the urging force of the urging spring.

By detecting the passage of the sheet with the sheet detecting device in the above-described manner, the image forming apparatus can use the detection result as a criterion for various control operations and can detect sheet jamming, double feeding, etc.

In recent years, there has been a demand for even higher throughput of image forming apparatuses, and therefore, a reduction in the space between the trailing end of the preceding sheet and the leading end of the succeeding sheet (hereinbelow, "sheet interval") is required.

According to the configuration disclosed in Japanese Patent Laid-Open No. 2003-252483, by disposing a detection flag coaxially with a conveyance roller, the rotational angle of the detection flag is reduced, making it possible to detect a small sheet interval.

According to the configuration disclosed in Japanese Patent Laid-Open No. 2012-144350, by making the rotational center of a detection flag changeable, the time for the detection flag to return to the initial position is reduced, making it possible to detect a small sheet interval.

SUMMARY

Some embodiments provide a sheet detecting device and an image forming apparatus that can detect a small sheet interval with a simple configuration and that can suppress damage to the leading end of a sheet.

Some embodiments of a sheet detecting device include a contact member that comes into contact with a conveyed sheet and is rotated; a detection member attached to the contact member; a sensor configured to detect rotation of the detection member; a first urging member configured to act on the detection member and the contact member; and a stopper with which the detection member comes into contact. After the contact member and the detection member are integrally rotated as a result of the contact member being pushed by the sheet, the contact member can be further rotated relative to the detection member, with the detection member being in contact with the stopper.

Further features and aspects will become apparent from the following description of exemplary embodiments with reference to the attached drawings.

DESCRIPTION OF THE EMBODIMENTS

Figure 1:
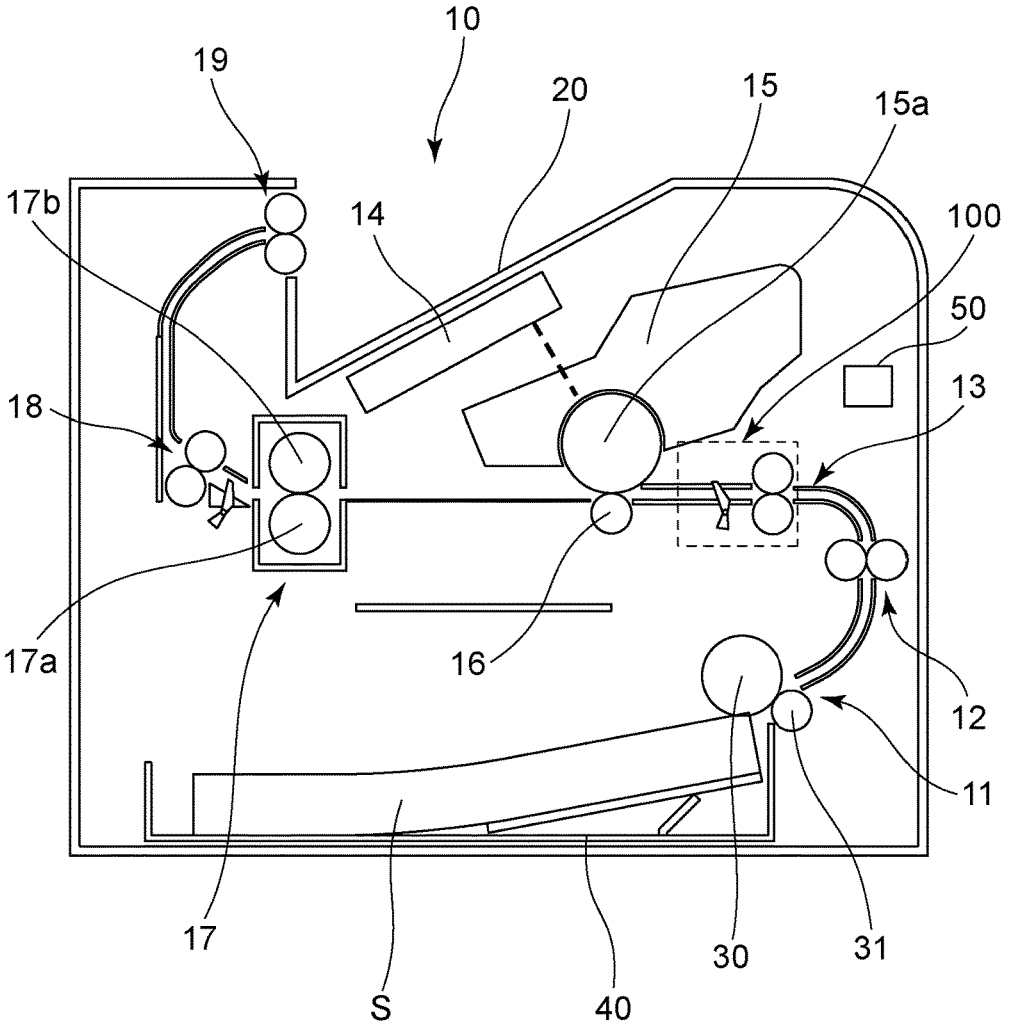
FIG. 1 is a schematic diagram showing the configuration of a main unit of an image forming apparatus.

Referring to the drawings, specific embodiments will be described below, in which the embodiments are applied to an electrophotographic laser printer, serving as an example of an image forming apparatus having a sheet detecting device. Note that the sizes, materials, shapes, relative positions, etc., of the components described in the following description of the embodiments are not intended for limiting the scope of the present disclosure to the values mentioned, unless otherwise specifically stated. Furthermore, the sheet detecting device may be applied not only to laser printers, but also to copiers, facsimiles, image reading devices, various finishers, etc.

First Embodiment

A first embodiment will be described below.

FIG. 1 is a schematic sectional view showing the overall configuration of an image forming apparatus. An image forming apparatus 10 includes a feeding cassette 40 that contains sheets S; a sheet conveyance path for conveying a sheet S, an image forming part for forming an image, and a fixing part 17 for fixing the image, which serve as devices for forming and fixing an image on the sheet S.

A sheet separating part 11 separates sheets S contained in the feeding cassette 40 into individual sheets S with a sheet feeding roller 30 and a sheet separating roller 31 and feeds the sheets S to the image forming part via conveyance roller pairs 12 and 13.

The image forming part includes an exposure device 14, a process cartridge 15, and a transfer roller 16. The process cartridge 15 includes a photosensitive drum 15*a*, a charger (not shown), and a developing part (not shown). The photosensitive drum 15*a* is formed of a metal cylinder having a negatively charged photosensitive layer formed on the surface thereof. The charger uniformly charges the surface of the photosensitive drum 15*a*, serving as the image bearing member. The exposure device 14 irradiates the photosensitive drum 15*a* with laser, shown by a dashed line in FIG. 1, according to image information, thereby forming an electrostatic latent image. The developing part visualizes the electrostatic latent image as a toner image by causing toner to attach to the electrostatic latent image. The transfer roller 16 transfers the toner image on the photosensitive drum 15*a* to the sheet S.

The fixing part 17 includes a pressure roller 17*a* and a fixing roller 17*b* having a heater provided therein. The fixing part 17 applies heat and pressure to the sheet S passing therethrough, thereby fixing the transferred toner image to the sheet S.

Thereafter, the sheet S is sent to a discharge roller pair 19 by a conveyance roller pair 18 and is discharged onto a discharge tray 20.

A sheet detecting device 100 detects the passage of the sheet S during conveyance, uses the detection result as a criterion for various control operations, and also detects conveyance problems, such as sheet jamming and double feeding.

Figure 2A:
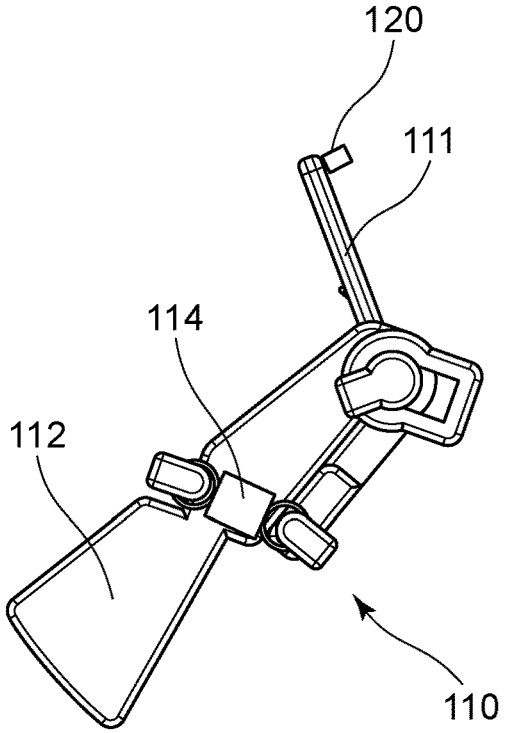
FIGS. 2A and 2B are a side view and a perspective view of a detection flag according to a first embodiment.
Figure 2B:
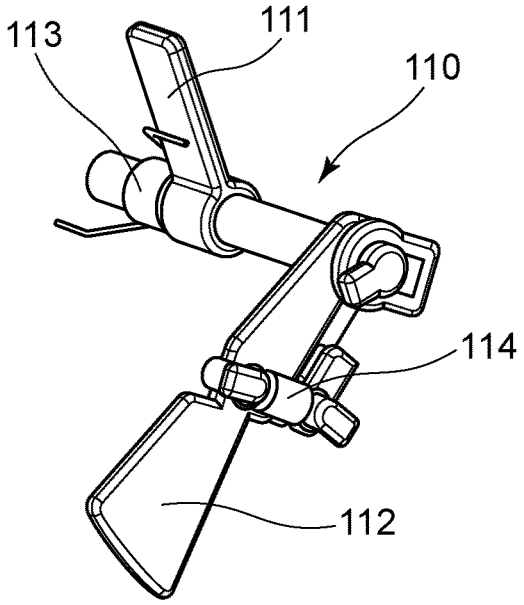

FIG. 2A is a side view of a flag unit 110 of the sheet detecting device 100, and FIG. 2B is a perspective view of the flag unit 110 of the sheet detecting device 100. A detection flag (contact member) 111, with which the sheet S comes into contact, is rotated by being pushed by the sheet S. A detection member 112 is a portion of which position is detected by a sensor 124 (described below). The detection member 112 is attached to the rotation shaft of the detection flag 111 so as to be able to rotate. A second urging member (spring) 113 urges the detection flag 111 toward a standby position, and a first urging member (spring) 114 urges (applies a force to) the detection member 112 and the detection flag 111 toward each other. As shown in FIG. 2A, the detection flag 111 urged by the second urging member 113 is located at the standby position by being abutted on a positioning part 120.

Figure 3:
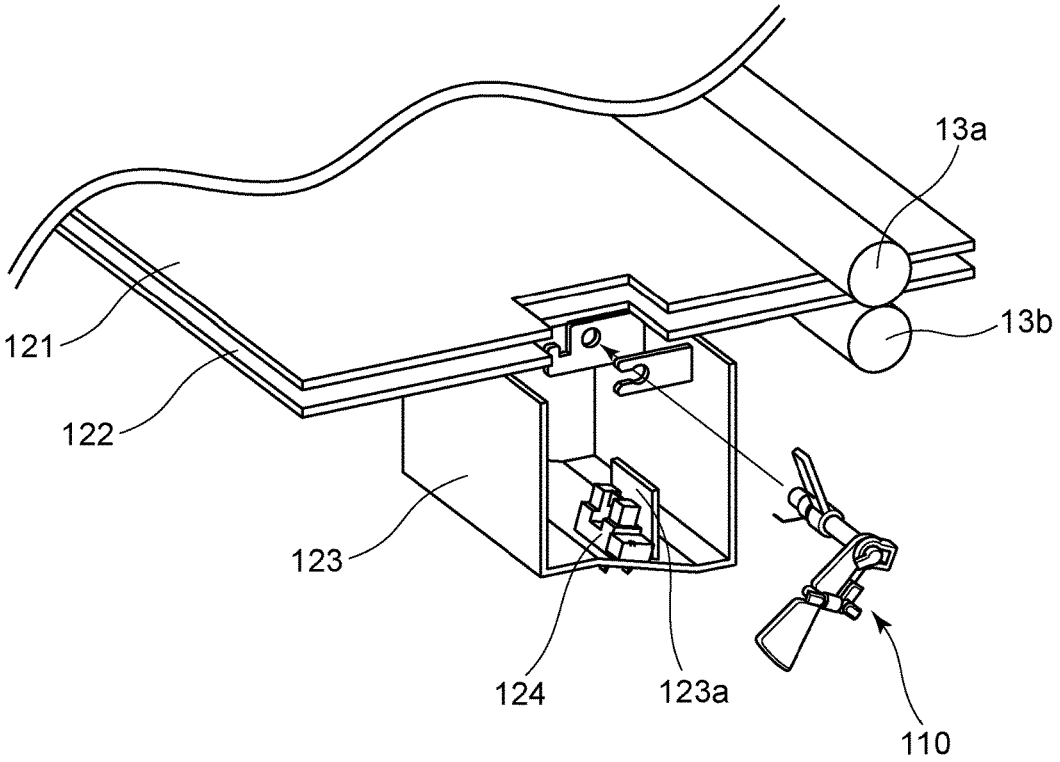
FIG. 3 is a diagram for explaining the configuration of a sheet detecting device according to the first embodiment.

FIG. 3 is a perspective view of a substantially central portion, in the sheet width direction, of the sheet detecting device 100. An upper guide 121 and a lower guide 122 form the sheet conveyance path, and an upper conveyance roller 13*a* and a lower conveyance roller 13*b* convey the sheet S. A sensor holder (holding member) 123 is attached below the lower guide 122, and the flag unit 110 is rotatably attached to an attachment hole provided in the sensor holder 123. A sensor 124 is attached to the sensor holder 123, and an abutting portion (stopper) 123*a*, with which the detection member 112 comes into contact, is provided on the sensor holder 123, near the sensor 124. The sensor 124 is an optical sensor, and, when the detection member 112 blocks an optical path, the sensor 124 reports (outputs) "ON", and when the optical path is not blocked, the sensor 124 reports "OFF". The output of the sensor 124 changes according to the rotation of the detection member 112, and, a CPU (control unit) 50, as shown in FIG. 1, can detect the sheet S, on the basis of the change in the output of the sensor 124.

FIGS. 4A to 4H are side views showing the operation of the flag unit 110 of the sheet detecting device 100 in a chronological order. In FIGS. 4A to 4H, the second urging member 113 is not shown.

Figure 4A:
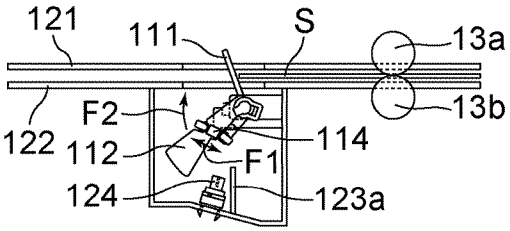
FIGS. 4A to 4H are diagrams for explaining, in outline, the movement of the sheet detecting device according to the first embodiment.

FIG. 4A shows a state immediately before the leading end of a sheet S comes into contact with the detection flag 111. At this time, the detection flag 111 receives an urging force, denoted by F2, from the second urging member 113 and is located at the standby position in a state being in contact with the positioning part 120 (FIG. 2A). In this state, the detection flag 111 and the detection member 112 pull each other by receiving urging forces, denoted by F1, from the first urging member 114. Because the detection flag 111 and the detection member 112 are integrated, the urging forces F1 do not affect the rotation of the flag unit 110.

Figure 4B:
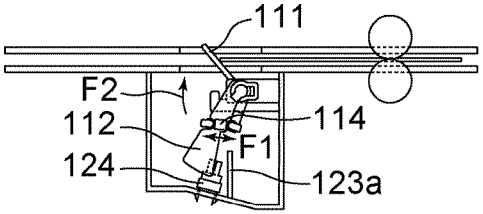

FIG. 4B shows a state in which the sheet S comes into contact with the detection flag 111, rotating the detection flag 111 by a predetermined amount, and the sensor 124 detects "ON". Also at this time, because the detection flag 111 and the detection member 112 are integrated, the detection flag 111 rotated by being pushed by the sheet S is rotated integrally with the detection member 112. Also in the state shown in FIG. 4B, similarly to the state shown in FIG. 4A, the urging force F2 and the urging forces F1 are acting.

Figure 4C:
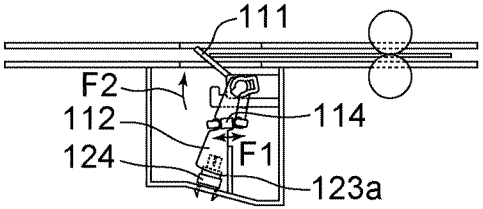

FIG. 4C shows a state in which the sheet S in the state of FIG. 4B further rotates the detection flag 111, and the detection member 112 and the abutting portion 123*a* are in contact with each other. The detection flag 111 and the detection member 112 are rotated integrally until this state is achieved. Also in the state shown in FIG. 4C, similarly to the state shown in FIG. 4A, the urging force F2 and the urging forces F1 are acting. At this time, the portion of the detection flag 111 that comes into contact with the sheet S is configured to be inclined with respect to the sheet conveyance direction. This configuration makes it possible to minimize the force applied to the leading end of the sheet S in the conveyance direction, even in the states shown in FIGS. 4C to 4H. Because the sensor 124 detects the presence of the detection member 112 in a state in which the detection member 112 is in contact with the abutting portion 123*a*, the sheet S passing on the sheet conveyance path is detected. In other words, the output of the sensor 124 differs between the state in which the detection flag 111 and the detection member 112 are located at the standby position and the state in which the detection member 112 is in contact with the abutting portion. The CPU 50 of the sheet detecting device 100 can detect the passage of the sheet S on the sheet conveyance path, on the basis of the change in the output of the sensor 124.

Figure 4D:
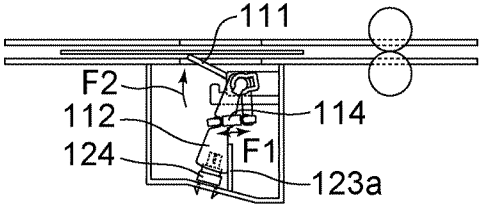

FIG. 4D shows a state in which the leading end of the sheet S has passed through the detection flag 111, and the detection flag 111 has been rotated further, beyond the state shown in FIG. 4C. Because the detection member 112 is in contact with the abutting portion 123*a*, the detection member 112 does not move from the position shown in FIG. 4C, and only the detection flag 111 is rotated further. In other words, as a result of the detection flag 111 being pressed by the sheet S, the detection flag 111 is rotated relative to the detection member 112 by overcoming the urging force F2 of the second urging member 113 and the urging forces F1 of the first urging member 114. At this time, like the states shown in FIGS. 4A to 4C, the urging force F2 is acting. Furthermore, because the detection flag 111 and the detection member 112 are separated, and the detection member 112 is in contact with the abutting portion 123*a* and is stopped, the urging forces F1 act in the direction in which the detection flag 111 is returned to the standby position.

Figure 4E:
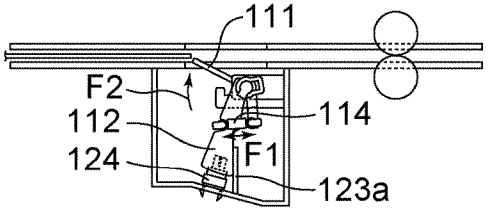

FIG. 4E shows a state in which the trailing end of the sheet S has passed through the detection flag 111. From the state shown in FIG. 4D to this state, the flag unit 110 receives a uniform force.

Figure 4F:
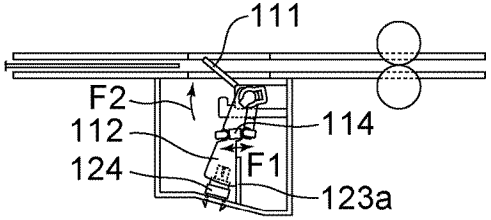

FIG. 4F shows a state in which the detection flag 111 has been pulled back until it comes into contact with the detection member 112. From this state on, the urging force F2 urges the flag unit 110 toward the direction of the standby position.

Figure 4G:
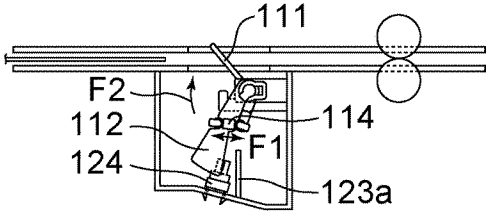

FIG. 4G shows a state in which the detection flag 111 and detection member 112, integrated together, are passing through the position where the sensor 124 detects "ON". From the state shown in FIG. 4E to this state, the detection flag 111 simultaneously receives the urging force F2 and the urging forces F1 and is urged toward the standby position.

Figure 4H:
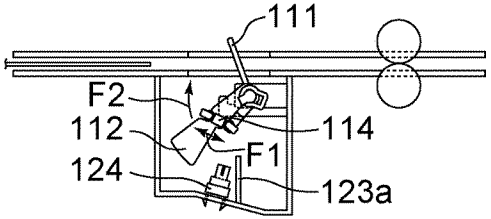

FIG. 4H shows a state in which the detection flag 111 and detection member 112, integrated together, have been returned to the standby position. After the detection flag 111 and the detection member 112 have returned to the standby position, the succeeding sheet S is conveyed, and the above-described sheet detecting operation is repeated.

As has been described above, according to the first embodiment, after the detection flag 111, pressed and rotated by the sheet S, has rotated integrally with the detection member 112, the detection flag 111 can further rotate relative to the detection member 112, in a state in which the detection member 112 is in contact with the abutting portion 123*a* and is stopped. Thus, it is possible to reduce the moving amount of the detection member 112, achieving a compact space.

Furthermore, according to the first embodiment, it is possible to detect the detection member 112 with the sensor 124, in a state in which the detection member 112 is in contact with the abutting portion 123*a*. Hence, it is possible to cancel variations in the positional accuracy of the detection member 112 and the sensor 124.

In the first embodiment, the abutting portion 123*a* is provided on (formed as an integral part of) the sensor holder 123, to which the sensor 124 is attached. Hence, it is possible to reduce the distance between the position where the detection member 112 is detected and the position where the detection member 112 comes into contact with the abutting portion 123*a*, and to maintain high positional accuracy of the sensor 124 and the abutting portion 123*a*. As a result, it is possible to achieve a compact space and to reduce the moving amount of the detection member 112 when detecting the trailing end of the sheet S, and consequently, it is possible to detect a small sheet interval.

Furthermore, in the first embodiment, because the portion of the detection flag 111 that comes into contact with the sheet S when detecting the sheet S is tilted with respect to the sheet conveyance direction, the damage to the leading end of the sheet S can be suppressed.

Second Embodiment

A second embodiment will be described below. In the description of the second embodiment below, explanations of the configuration and the operation common to those according to the first embodiment will be omitted.

Figure 5A:
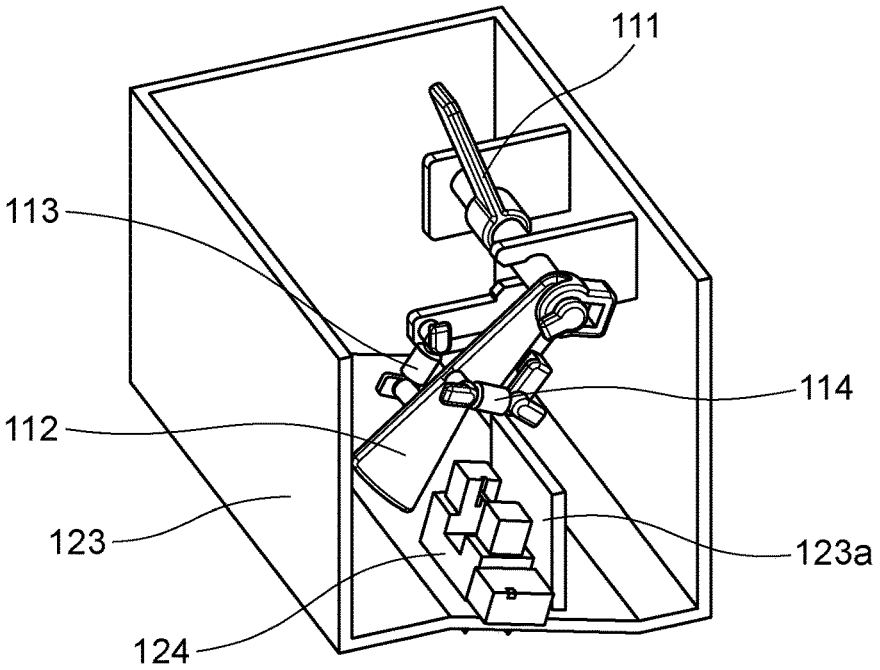
FIGS. 5A and 5B are diagrams for explaining the configuration of a sheet detecting device according to a second embodiment and forces acting therein.

FIG. 5A shows the configuration of the sheet detecting device 100 according to the second embodiment. Although the second urging member 113 is attached to the detection flag 111 in the first embodiment, the second urging member 113 is attached to the detection member 112 in this embodiment.

Figure 5B:
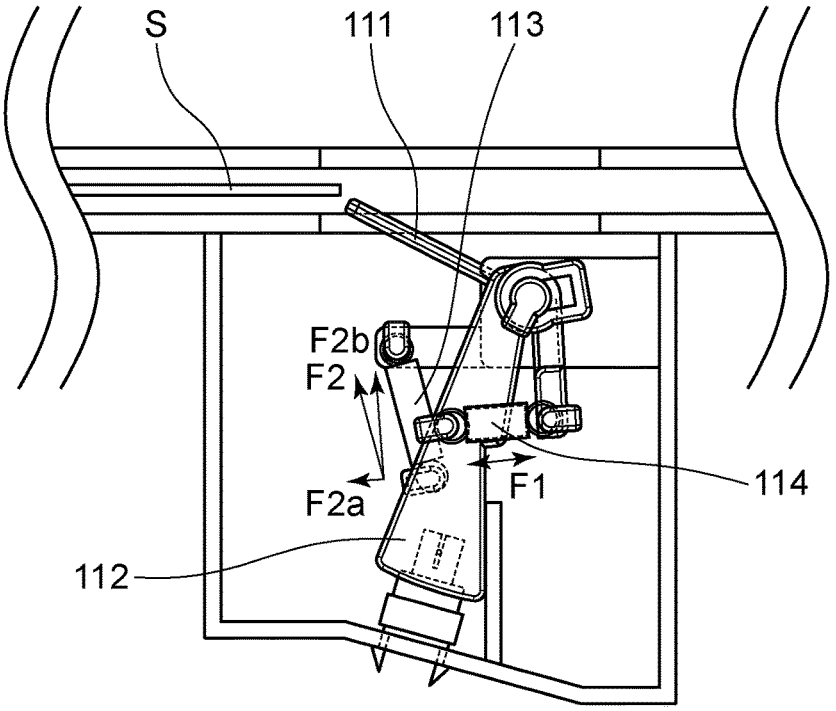

FIG. 5B shows forces that are applied to the flag unit 110 according to the second embodiment from the second urging member 113 and the first urging member 114. FIG. 5B shows, as an example, a state in which the trailing end of the sheet S has passed through the detection flag 111. A force F2*a* is a component of force obtained by decomposing a force F2 in the same direction as forces F1, and a force F2*b* is a component of force obtained by decomposing the force F2 in the direction perpendicular to the force F2*a*. In this embodiment, the pressures (urging forces) of the second urging member 113 and the first urging member 114 are set so as to always satisfy the relationship F2*a*<F1 during a series of sheet-detecting operations.

FIGS. 6A to 6H are side views showing the operation of the flag unit 110 in a chronological order.

Figure 6A:
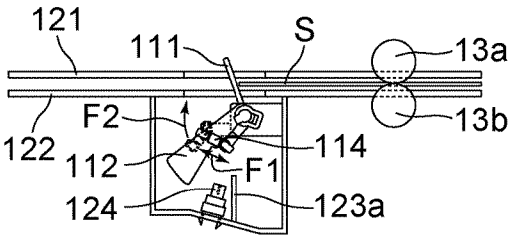
FIGS. 6A to 6H are diagrams for explaining, in outline, the movement of the sheet detecting device according to the second embodiment.
Figure 6B:
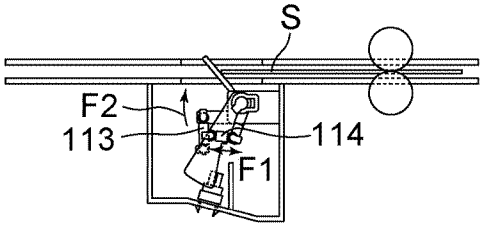
Figure 6C:
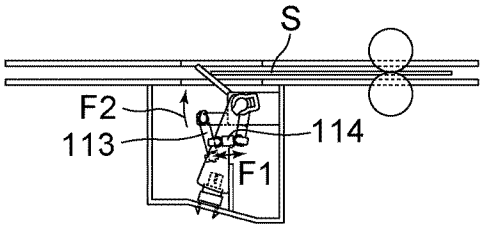
Figure 6D:
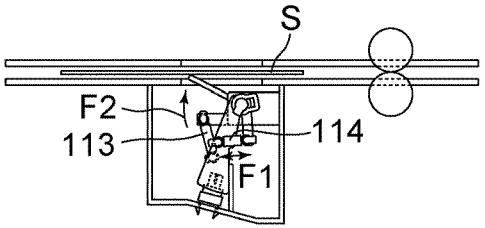
Figure 6E:
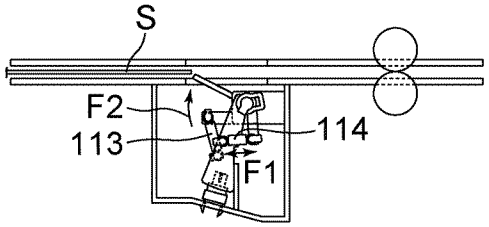

Because the operation of the flag unit 110 is the same as that according to first embodiment up to the state shown in FIG. 6E, except for the feature that the urging force F2 of the second urging member 113 is acting on the detection member 112, a detailed explanation will be omitted.

Figure 6F:
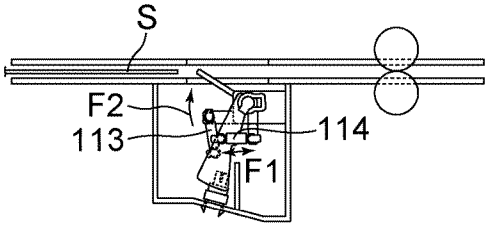

FIG. 6F shows a state in which the detection flag 111 and the detection member 112 start to return toward the standby position. Because the second urging member 113 is attached to the detection member 112, the detection member 112 starts to return toward the standby position due to the urging force F2, before the detection flag 111 and the detection member 112 are integrated by the effect of the urging forces F1. That is, returning of the detection member 112 toward the standby position and integration of the detection flag 111 and the detection member 112 progress simultaneously.

Figure 6G:
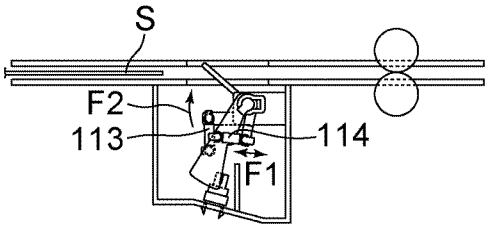

FIG. 6G shows a state in which the detection member 112 is passing through the position where the sensor 124 detects "ON". As has been described above, according to the second embodiment, because returning of the detection member 112 toward the standby position and integration of the detection flag 111 and the detection member 112 progress simultaneously, the time for the detection member 112 to pass through the position where the sensor 124 detects "ON" is shorter than that in the first embodiment.

Figure 6H:
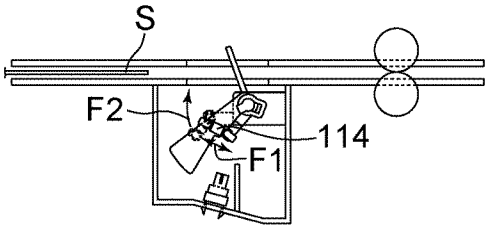

FIG. 6H shows a state in which the detection flag 111 and detection member 112, integrated together, have been returned to the standby position. Similarly to the first embodiment, after the detection flag 111 and the detection member 112 have returned to this state, the succeeding sheet S is conveyed, and the above-described sheet detecting operation is repeated.

With this configuration, according to the second embodiment, it is possible to detect an even smaller sheet interval, compared with the first embodiment.

Third Embodiment

A third embodiment will be described below. In the description of the third embodiment below, explanations of the configuration and the operation common to those according to the first embodiment will be omitted.

Figure 7A:
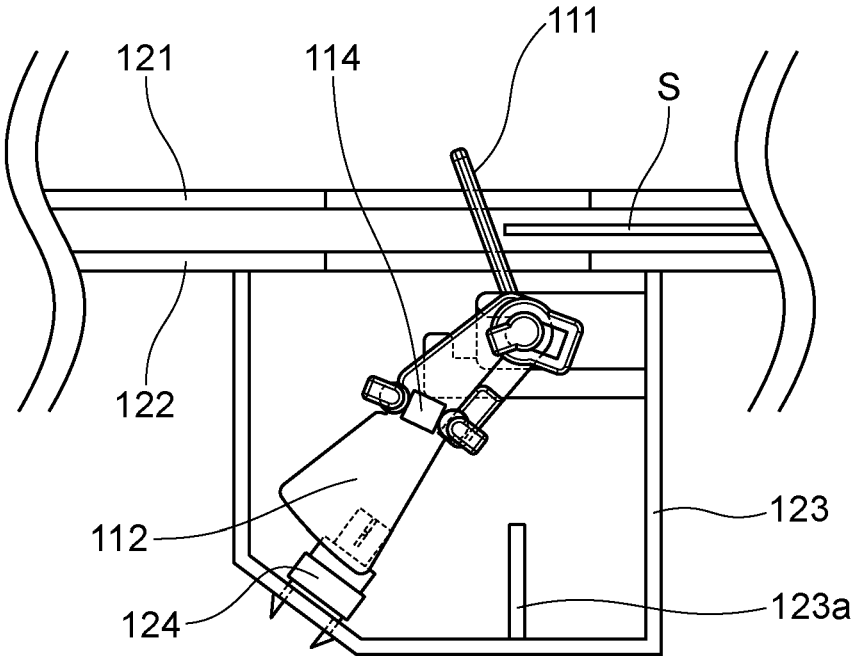
FIGS. 7A and 7B are diagrams for explaining the configuration of a sheet detecting device according to a third embodiment.
Figure 7B:
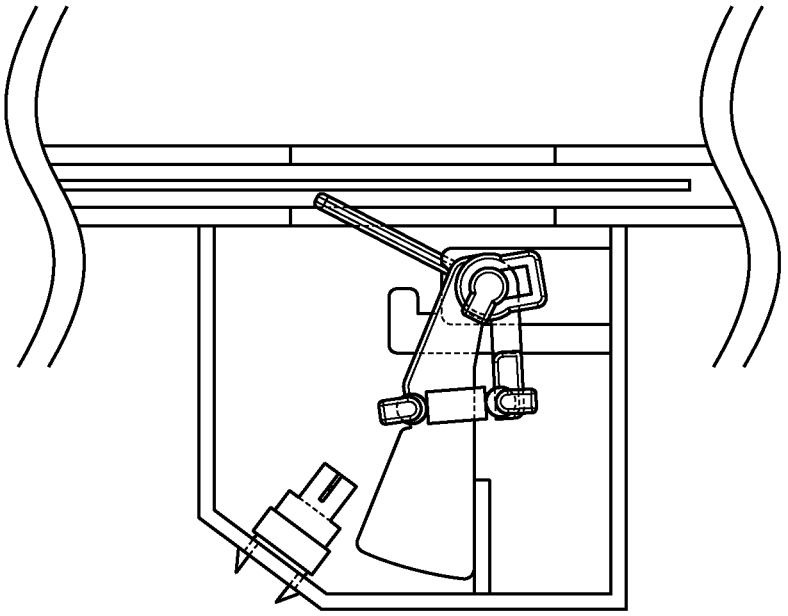

FIGS. 7A and 7B show, in outline, the configuration of the sheet detecting device 100 according to the third embodiment.

In the first and second embodiments, when the flag unit 110 is located at the standby position, the sensor 124 is OFF, whereas when the flag unit 110 is detecting the sheet S, the sensor 124 is ON. In contrast, in the third embodiment, when the flag unit 110 is located at the standby position, as shown in FIG. 7A, the sensor 124 is ON, whereas when the flag unit 110 is detecting the sheet S, as shown in FIG. 7B, the sensor 124 is OFF.

This configuration increases the design flexibility, compared with the first and second embodiments, and enables a further reduction in size of the sheet detecting device 100.

Fourth Embodiment

A fourth embodiment will be described below. In the description of the fourth embodiment below, explanations of the configuration and the operation common to those according to the first embodiment will be omitted.

Figure 8:
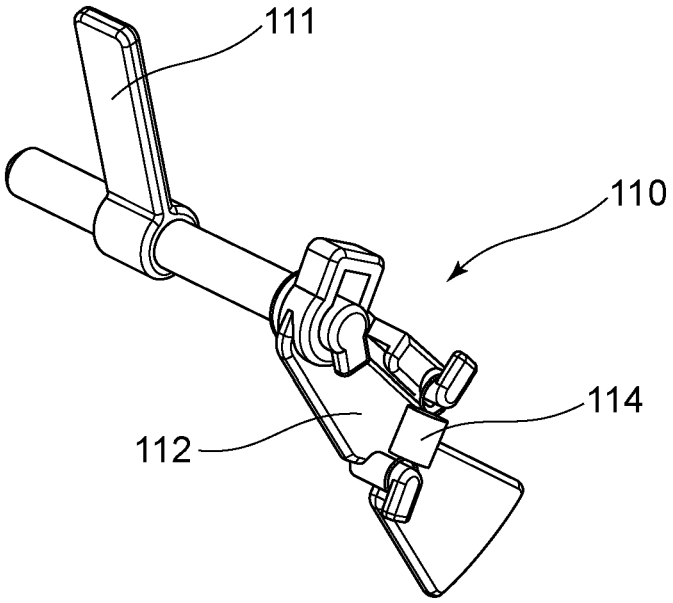
FIG. 8 is a diagram for explaining the configuration of a sheet detecting device according to a fourth embodiment.

FIG. 8 shows the configuration of the flag unit 110 according to the fourth embodiment. In this embodiment, the second urging member 113 is not provided, and the attachment angle of the detection member 112 relative to the detection flag 111 is different from that according to the first embodiment. The shape of the sensor holder 123 and the positions of the abutting portion 123*a* and the sensor 124 are changed accordingly.

Forces applied to the flag unit 110 will be described with reference to FIGS. 9A and 9B.

Figure 9A:
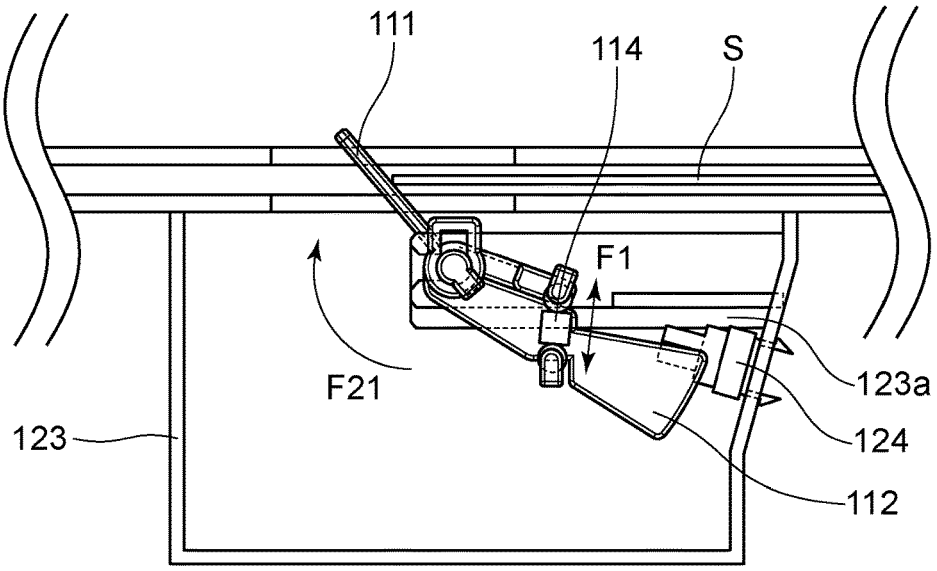
FIGS. 9A and 9B are diagrams for explaining forces acting in the sheet detecting device according to the fourth embodiment.

FIG. 9A shows a state in which the flag unit 110 is located at the standby position and the detection flag 111 and the detection member 112 are integrated. At this time, because the detection flag 111 and the detection member 112 are integrated, the urging forces F1 do not affect the rotation of the flag unit 110. The flag unit 110 is urged toward the standby position by an urging force F21 caused by its own weight.

Figure 9B:
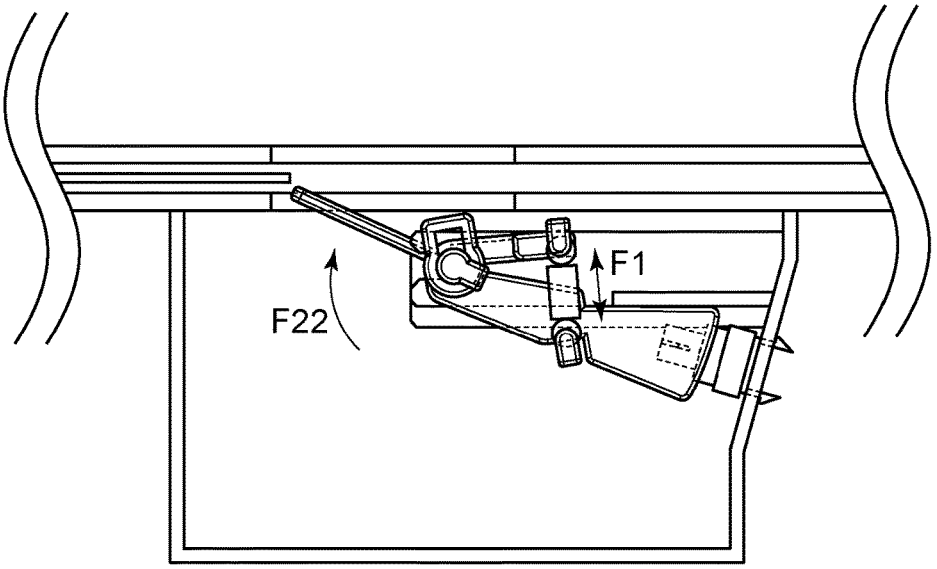

FIG. 9B shows a state in which the trailing end of the sheet S has passed through the detection flag 111. At this time, the detection flag 111 and the detection member 112 are separated, and the detection flag 111 is urged toward the standby position by receiving the urging forces F1 of the first urging member 114, in addition to an urging force F22 caused by its own weight.

This configuration does not require the second urging member 113 employed in the first to third embodiments, and thus, it is possible to configure a sheet detecting device at an even lower cost.

While the sheet detecting device has been described with reference to exemplary embodiments, it is to be understood that the claims are not limited to the disclosed exemplary embodiments. The scope of the following claims is to be accorded the broadest interpretation so as to encompass all such modifications and equivalent structures and functions.

This application claims the benefit of Japanese Patent Application No. 2015-053016, filed Mar. 17, 2015, which is hereby incorporated by reference in its entirety.

What is claimed is:

1. A sheet detecting device comprising:

a contact member that comes into contact with a conveyed sheet and is rotated;

a detection member configured to be rotatable independently from the contact member, the detection member being a different member from the contact member;

a sensor configured to detect the detection member;

a first urging member configured to act on the detection member and the contact member;

a second urging member configured to act on the contact member such that the contact member and the detection member are located at a standby position;

a positioning part configured to position the contact member urged by the second urging member; and a stopper with which the detection member comes into contact, wherein, after the contact member and the detection member are integrally rotated from the standby position as a result of the contact member being pushed by the sheet, the contact member can be further rotated relative to the detection member in a state where the detection member is in contact with the stopper and in a case where the sensor has detected the detection member.

2. The sheet detecting device according to claim 1, wherein the first urging member urges the detection member and the contact member toward each other.

3. The sheet detecting device according to claim 2, wherein the contact member and the detection member are configured to be located at the standby position by their own weight.

4. The sheet detecting device according to claim 1, further comprising a holding member to which the sensor is attached, wherein the stopper is provided on the holding member.

5. The sheet detecting device according to claim 1, wherein the sensor detects a sheet in a state in which the detection member is in contact with the stopper.

6. The sheet detecting device according to claim 1, wherein the contact member can be moved from the standby position by being pushed by the sheet, and wherein the sensor does not detect the sheet in a state in which the contact member is located at the standby position.

7. The sheet detecting device according to claim 1, wherein the sensor is an optical sensor.

8. An image forming apparatus comprising:

an image forming part configured to form an image on a sheet; and a sheet detecting device comprising:

a contact member that comes into contact with a conveyed sheet and is rotated;

a detection member configured to be rotatable independently from the contact member, the detection member being a different member from the contact member;

a sensor configured to detect the detection member;

a first urging member configured to act on the detection member and the contact member;

a second urging member configured to act on the contact member such that the contact member and the detection member are located at a standby position;

a positioning part configured to position the contact member urged by the second urging member; and a stopper with which the detection member comes into contact, wherein, after the contact member and the detection member are integrally rotated from the standby position as a result of the contact member being pushed by the sheet, the contact member can be further rotated relative to the detection member in a state where the detection member is in contact with the stopper and in a case where the sensor has detected the detection member.

* * * * *